United States Patent [19]

Bertus et al.

[11] 4,167,471

[45] Sep. 11, 1979

[54] PASSIVATING METALS ON CRACKING CATALYSTS

[75] Inventors: Brent J. Bertus; Dwight L. McKay, both of Bartlesville, Okla.

[73] Assignee: Phillips Petroleum Co., Bartlesville, Okla.

[21] Appl. No.: 929,479

[22] Filed: Jul. 31, 1978

[51] Int. Cl.[2] ..... C10G 11/06; C10G 9/16; B01J 8/24

[52] U.S. Cl. ..... 208/74; 208/48 R; 208/48 AA; 208/113; 208/114; 252/437; 260/446; 423/617

[58] Field of Search ..... 208/74, 48 R, 48 AA, 208/113–124

[56] References Cited

U.S. PATENT DOCUMENTS

| | | | |
|---|---|---|---|
| 3,647,677 | 3/1972 | Wolff et al. | 208/48 AA |
| 3,711,422 | 1/1973 | Johnson et al. | 252/414 |
| 3,776,835 | 12/1973 | Dvoracek | 208/106 X |
| 3,812,029 | 5/1974 | Snyder | 208/113 |
| 3,977,963 | 8/1976 | Readal et al. | 208/120 |
| 4,024,049 | 5/1977 | Shell et al. | 208/48 AA |
| 4,025,458 | 5/1977 | McKay | 252/416 |
| 4,031,002 | 6/1977 | McKay | 208/113 |
| 4,097,366 | 6/1978 | Tanaka et al. | 208/127 |

*Primary Examiner*—Delbert E. Gantz
*Assistant Examiner*—G. E. Schmitkons

[57] ABSTRACT

Metals such as nickel, vanadium and iron contaminating a cracking catalyst are passivated by contacting the contaminated catalyst with a passivating agent dissolved in a secondary feedstock stream having a temperature sufficiently low to avoid or minimize decomposition of the passivating agent.

26 Claims, 1 Drawing Figure

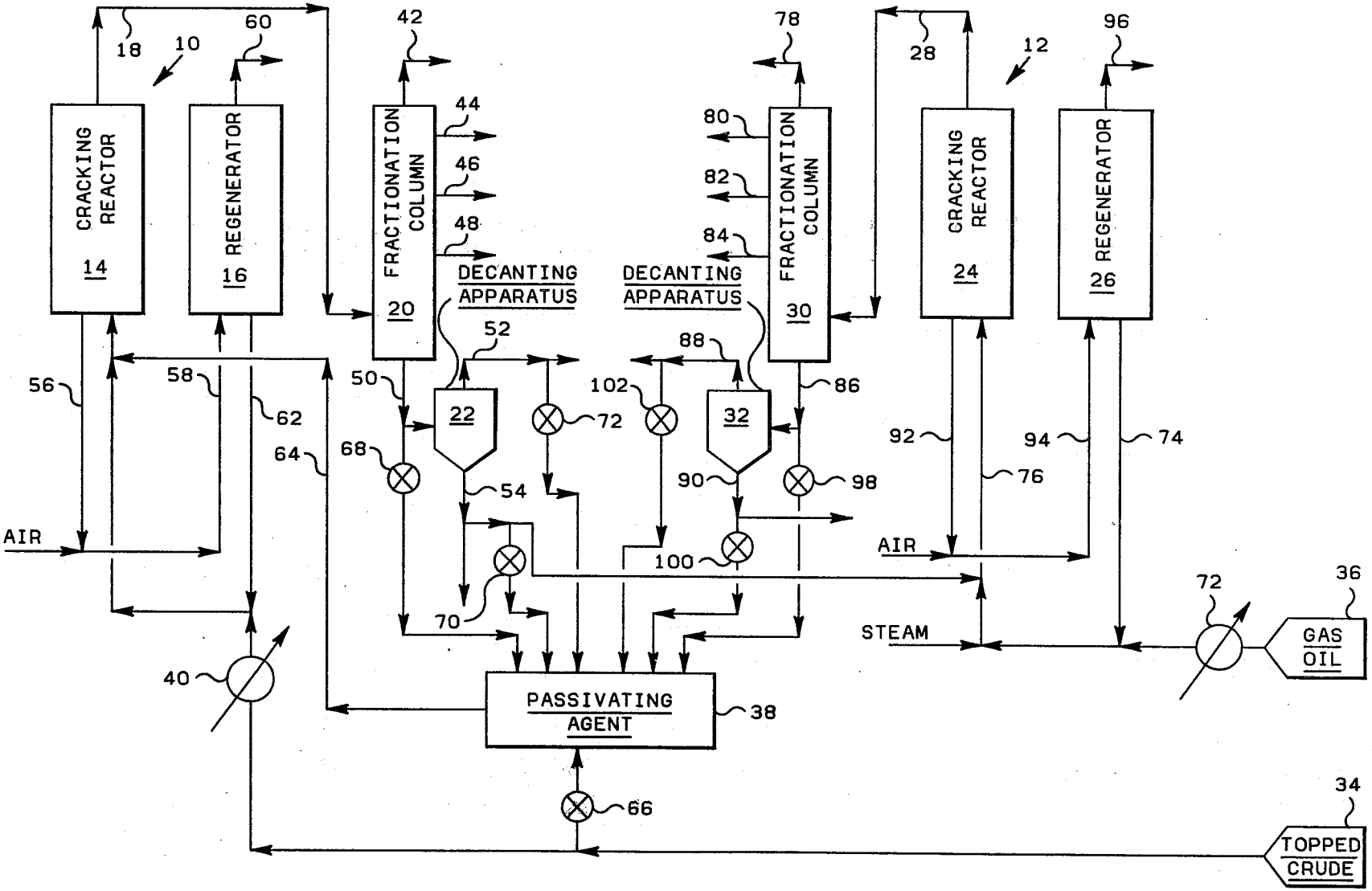
GAS OIL
TOPPED CRUDE
REGENERATOR
CRACKING REACTOR
FRACTIONATION COLUMN
DECANTING APPARATUS
PASSIVATING AGENT
STEAM
AIR

PASSIVATING METALS ON CRACKING CATALYSTS

The invention relates generally to catalytic cracking of hydrocarbons. In one aspect the invention relates to regeneration of used cracking catalysts. In another aspect the invention relates to passivation of contaminating metals on cracking catalysts.

Feedstocks containing higher molecular weight hydrocarbons are cracked by contacting the feedstocks under elevated temperatures with a cracking catalyst whereby light distillates such as gasoline are produced. However, the cracking catalyst gradually deteriorates during this process. One source of such deterioration is the deposition of contaminating metals such as nickel, vanadium and iron on the catalyst which increases the production of hydrogen and coke while, at the same time, causing a reduction in the conversion of hydrocarbons into gasoline. It is, therefore, desirable to have a modified cracking catalyst available, the modifying agent of which passivates these undesirable metal deposits on the cracking catalyst.

A desirable way to add passivating agents to catalytic cracking units to passivate such undesirable metal deposits on the cracking catalyst is by dissolution of the passivating agents in the hydrocarbon feedstock. This increases the probability that the active passivating element or elements in the passivating agent will reach the catalyst and be deposited where most effective. To be hydrocarbon-soluble, it is generally required that the passivating element or elements be incorporated in an organic compound. This compound may, however, be sufficiently labile to at least partially thermally decompose in preheated primary hydrocarbon feedstock before it ever comes into contact with cracking catalyst. It would, therefore, be desirable to eliminate or substantially reduce any thermal decomposition of thermally labile passivation agents prior to contacting the cracking catalyst therewith.

It is thus an object of this invention to provide an improved process for the passivation of contaminating metals deposited on cracking catalyst.

Another object of this invention is to provide a process for the restoration of used cracking catalyst.

Still another object of this invention is to provide a process for the passivation of cracking catalyst wherein premature decomposition of thermally labile passivation agents is eliminated or substantially reduced.

Other objects, advantages and aspects of the invention will be readily apparent to those skilled in the art from a reading of the following detailed description and claims and accompanying drawings in which:

The single FIGURE is a schematic diagram of a catalytic cracking, catalyst regeneration and product fractionating system illustrative of the process of the present invention.

In accordance with this invention, we have found that thermally labile passivation agents for metals-contaminated cracking catalysts can be introduced to the cracking reactor by adding them to a stream of hydrocarbon feedstock at a temperature lower than the thermal decomposition temperature of the passivation agent and less than the preheated primary hydrocarbon feedstock stream.

It has been found that contaminating heavy metals, such as vanadium, nickel and iron, deposited on cracking catalysts, thus causing deactivation thereof, can be passivated by contacting the deactivated cracking catalysts with a metals passivating agent which reduces the deleterious effects of such metals on the cracking catalysts. One such suitable metals passivating agent comprises at least one antimony compound having the general formula

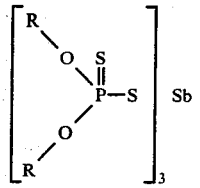

wherein each R is individually selected from the group consisting of hydrocarbyl radicals containing from 1 to about 18 carbon atoms, the overall number of carbon atoms per molecule being in the range of 6 to about 90, so as to passivate the contaminating metals. The antimony compounds are known chemical compounds. Among these antimony compounds the preferred ones are those wherein each R is individually selected from the group consisting of alkyl radicals having 2 to about 10 carbon atoms per radical, substituted and unsubstituted $C_5$ and $C_6$ cycloalkyl radicals and substituted and unsubstituted phenyl radicals. Specific examples of suitable R radicals are ethyl, n-propyl, isopropyl, n-, iso-, sec- and tert-butyl, amyl, n-hexyl, isohexyl, 2-ethylhexyl, n-heptyl, n-octyl, iso-octyl, tert-octyl, dodecyl, octyldecyl, cyclopentyl, methylcyclopentyl, cyclohexyl, methylcyclohexyl, ethylcyclohexyl, phenyl, tolyl, cresyl, ethylphenyl, butylphenyl, amylphenyl, octylphenyl, vinylphenyl and the like, the n-propyl and octyl radicals being presently preferred.

Since the antimony compounds useful in accordance with this invention for passivating the metals on the cracking catalyst can also be a mixture of different antimony compounds of the general formula given above, the treating agent can also be defined by the range of weight percentage of antimony based on the total weight of the composition of one or more antimony compounds. The preferred antimony composition of the treating agent thus can be defined to be within the range of about 6 to about 21 weight percent antimony based on the total weight of the composition of one or more antimony compounds.

The phosphorodithioate compounds can be prepared by reacting an alcohol or hydroxy substituted aromatic compound, such as phenol, with phosphorus pentasulfide to produce the dihydrocarbylphosphorodithioic acid. To produce the metal salts, the acid can be neutralized with antimony trioxide and the antimony derivatives recovered from the mixture. Alternately, the dihydrocarbylphosphorodithioic acid can be reacted with ammonia to form an ammonium salt which is reacted with antimony trichloride to form the antimony salt. The antimony compounds can then be recovered from the reaction mixtures.

Any suitable quantity of the antimony compound can be employed as a metals passivating agent in accordance with this invention. The range for the quantity of the antimony compound employed is related to the quantity of cracking catalyst to be treated, which quantity can vary considerably. The antimony compound generally will be employed in an amount such as to provide within the range of about 0.002 to about 5, and preferably in the range of about 0.01 to about 1.5 parts by weight of antimony per 100 parts by weight of conventional cracking catalyst (including any contaminating metals in the catalyst but excluding the antimony compound metals passivating agent).

In accordance with a preferred embodiment of the present invention, a cracking process is provided wherein at least a portion of a first hydrocarbon feedstock stream is introduced into a preheating zone so as to preheat at least a portion of the first feedstock stream to an elevated temperature, and at least a portion of the preheated first feedstock stream is introduced into a first cracking zone. At least a portion of the preheated first feedstock stream is contacted in the first cracking zone with a first cracking catalyst under elevated cracking temperature conditions so as to produce a first cracked product which first cracked product is withdrawn from the cracking zone and separated from at least a portion of the first cracking catalyst. At least a portion of the thus separated first cracking catalyst is introduced into a first regeneration zone where it is contacted with free oxygen-containing gas so as to burn off at least a portion of any coke deposited on the first cracking catalyst and provide a regenerated first catalyst. The regenerated first catalyst is then reintroduced into the first cracking zone. A metals passivating agent is introduced into a fluid stream comprising hydrocarbons so as to form a passivation stream at a temperature below the decomposition temperature of the metals passivating agent, and this passivation stream is introduced into the preheated first feedstock stream upstream from the first cracking zone so that the passivation stream and first feedstock stream are introduced together into the first cracking zone while the metals passivating agent is substantially free of decomposition until contacting the first cracking catalyst.

Two different, undesirable phenomena have been observed in connection with the use of the antimony salts of dihydrocarbylphosphorodithioic acids as passivating agents for the passivation of metals-contaminated catalyst, although these materials have been found to be effective to increase gasoline yield and to decrease hydrogen and coke production when applied to metals-contaminated cracking catalyst.

The first of these undesirable phenomena was revealed during a refinery test in which a passivating agent or additive in the form of the antimony salt of dipropylphosphorodithioic acid was pumped directly into primary hydrocarbon feedstock which had been previously preheated sufficiently to cause the additive to decompose to a resinous, insoluble form at the place where the passivating agent or additive line joined the pipe carrying the preheated primary hydrocarbon feedstock. In order to remove the obstruction thereby formed, it was necessary to disassemble the joint periodically to remove this resinous, insoluble deposit mechanically.

The second of these undesirable phenomena was revealed from thermal stability studies performed on an additive or passivating agent comprising about 80 weight percent of the antimony salt of dipropylphosphorodithioic acid and about 20 weight percent of mineral oil. In this form, the passivating agent decomposes exothermically when the wall temperature of lines and vessels in which it is contained exceeds about 149° C. (300° F.). A considerable fraction of the decomposition products of the passivating agent thus decomposed was found to be no longer soluble in hydrocarbon.

The invention will be more fully understood from the following examples which are, however, not intended to limit the scope thereof.

EXAMPLE I

The thermal stabilities of (1) Borger topped crude, containing no additive, (2) a solution containing about 6.6 weight percent triphenylantimony in Borger topped crude, and (3) a solution containing (a) about 21.6 weight percent of an additive containing about 80 weight percent of antimony O,O-dipropylphosphorodithioate compound and about 20 weight percent mineral oil, available under the tradename Vanlube 622 (hereinafter referred to as DPPD-MO), and (b) about 78.4 weight percent of Borger topped crude were evaluated. The thermal stability of each of these three fluids was evaluated by pumping the respective fluid through a 12-foot (3.66 m.) coil of 1/16-inch (0.16 cm) O.D. stainless steel tubing having a 0.032-inch (0.08 cm) I.D. with a Lapp pump. The stainless steel tubing was housed in a temperature controlled furnace. The temperature of the furnace was increased in a stepwise manner. At the end of each time period at a given furnace temperature the pressure drop through the length of heated tubing was measured and recorded for the respective fluid and the temperature of the furnace was then increased. The pressure drop or differential through the length of tubing served as the indicator of thermal stability of the fluid being pumped therethrough. Results of some thermal stability tests conducted on these three fluids are summarized in the following table.

TABLE I

THERMAL STABILITY TESTS

| Temperature °C. | Temperature (°F.) | Cumulative Run Time, Minutes | Residence Time of Fluid in Tube, Min. | Pressure Differential at End of Time Period, psig |
|---|---|---|---|---|
| Borger Topped Crude | | | | |
| 232 | (450) | 25 | 0.73 | 140 |
| 260 | (500) | 210 | 0.72 | 115 |
| 274 | (525) | 250 | 0.73 | 110 |
| 288 | (550) | 295 | 0.72 | 110 |
| 6.6 Wt. Percent Triphenylantimony In Borger Topped Crude | | | | |
| 266 | (510) | 123 | 0.69 | 92 |
| 288 | (550) | 213 | 0.69 | 85 |
| 299 | (570) | 328 | 0.69 | 85 |
| 316 | (600) | 448 | 0.69 | 98 |
| 21.6 Wt. Percent DPPD-MO In Boger Topped Crude | | | | |
| 252 | (485) | 200 | 0.57 | 100 |
| 260 | (500) | 325 | 0.57 | 190 |
| 288 | (550) | 415 | 0.57 | (a) |

(a) Essentially complete obstruction. Maximum capacity of pressure gauge was exceeded.

The pressure differential data in Table I indicate that no thermal decomposition is evidenced when Borger topped crude, having no additives added thereto, is exposed to temperatures ranging from 232° C. (450° F.) to 288° C. (550° F.). It will be noted that the pressure differential through the length of tubing actually decreases from 140 psig to 110 psig as the temperatures are increased.

Similarly, the pressure differential data in Table I indicate that no significant thermal decomposition occurs when the solution of 6.6 weight percent triphenylantimony in Borger topped crude is subjected to increasing temperatures ranging from 266° C. (510° F.) to 316° C. (600° F.). In this case the pressure differential through the length of tubing drops from an initial 92 psig to 85 psig and increases to a final 98 psig at 316° C. (600° F.).

The data in Table I does, however, indicate that significant thermal decomposition occurs in the 21.6 weight percent solution of DPPD-MO additive in Borger topped crude when this fluid is exposed to temperatures of 260° C. (500° F.) and higher. In this case the pressure differential increased from an initial value of 100 psig at 252° C. (485° F.) to a value of 190 psig at 260° C. (500° F.) and then exceeded the capacity of the pressure gage when the temperature was increased to 288° C. (550° F.).

From the data of Table I it is indicated that the maximum temperature to which the solution of DPPD-MO metals passivating additive in feedstock is exposed while being transported to the cracking catalyst preferably should not exceed 260° C.

EXAMPLE II

The antimony O,O-dipropylphosphorodithioate compound was compared with other known additives by tests on used active clay catalyst containing deposited contaminating metals. The catalyst was the commercially available F-1000 catalyst of the Filtrol Corporation which had been used in a commercial cracking unit. This catalyst, in unused condition as received from the manufacturer, contained about 0.4 weight percent of cerium and about 1.4 weight percent of lanthanum calculated as the metal as smaller amounts of other metal compounds. The weight percentages calculated as weight percent metal of these other metal components were as follows: 0.01 weight percent nickel, 0.03 weight percent vanadium, 0.36 weight percent iron, 0.16 weight percent calcium, 0.27 weight percent sodium, 0.25 weight percent potassium and less than 0.01 weight percent lithium. The used catalyst, in contrast, calculated on the same basis as before, contained 0.38 weight percent nickel, 0.60 weight percent vanadium, 0.90 weight percent iron, 0.28 weight percent calcium, 0.14 weight percent sodium, 0.27 weight percent potassium and less than 0.01 weight weight percent lithium. The unused catalyst has a pore volume of about 0.4 cc/g and a surface area of about 200 square meters/gram. The used catalyst had about the same pore volume and a surface area of about 72 square meters/gram.

Six portions of the used catalyst were impregnated with varying quantities of the antimony O,O-dipropylphosphorodithioate compound, six additional portions of the catalyst were impregnated with triphenylantimony, while the last six portions of the catalyst were impregnated with tributylphosphine. All the additives were used as solutions in dry cyclohexane. The quantities of the additives were adjusted such that the weight percentage of antimony for the first two series and the weight percentage of phosphorus for the third series of portions was as indicated in the following Table II.

The antimony O,O-dipropylphosphorodithioate was used in solution in a neutral hydrocarbon oil, said solution being commercially available under the tradename Vanlube 622. This solution contained 10.9 weight percent antimony, 9.05 weight percent phosphorus, 19.4 weight percent sulfur and less than 100 ppm halogens. This antimony O,O-dipropylphosphorodithioate compound corresponds to an antimony compound of the general formula set forth above wherein the hydrocarbyl groups are substantially propyl radicals. The impregnated catalysts were dried under a heat lamp and then heated to 900° F. (422° C.) in a bed fluidized with nitrogen. The catalyst samples were all preaged by processing them through ten cracking-regeneration cycles in a laboratory-sized confined fluid bed reactor system in which the catalyst was fluidized with nitrogen, the feed being a topped crude oil feed from Borger, Texas. One cycle normally consisted of nominal 30-second oil feeding time during cracking after which the hydrocarbons were stripped from the system with nitrogen for about 3 to 5 minutes. The reactor was then removed from a sand bath heater and purged with nitrogen as it cooled to room temperature in about 10 minutes. The reactor and its contents were then weighed to determine the weight of any coke deposited on the catalyst during the run. The reactor was then replaced in the sand bath, and while it was heated to regeneration temperature, air was passed through it. The overall regeneration time was about 60 minutes. The reactor was then cooled to reaction temperature and purged with nitrogen. Then, another cracking-regeneration cycle was started.

With these catalyst samples, Kansas City gas oil having an API gravity of 30.2 at 60° F. (15° C.), a pour point of 100° F. (38° C.) and a viscosity of 39 SUS at 210° F. (100° C.) was cracked. The cracking was carried out in a laboratory size fixed bed reactor system at 900° F. (482° C.). The oil-to-catalyst ratio was adjusted to a 75 volume percent conversion rate.

The selectivity to gasoline, the coke content and the hydrogen production were measured. All results were compared relative to the results obtained with a catalyst containing no treating agent which were arbitrarily given a rating of 1.00. The selectivity to gasoline is defined as the volume of liquid products boiling below 400° F. (204° C.) divided by the volume of oil converted times 100. The oil converted is the volume of feed minus the volume of recovered liquid boiling above 400° F. (204° C.). Thus, for instance, if the selectivity of the gasoline of the untreated catalyst was 50 volume percent, selectivity of a treated catalyst of 1.04 in the following table would refer to a selectivity of 52 volume percent of this treated catalyst.

The coke content of the catalyst is measured by weighing the dry catalyst after the cracking process. The hydrogen quantity produced is determined in standard equipment analyzing the hydrogen content of the gaseous products leaving the reactor.

The results of these various runs are shown in the following Table II:

TABLE II

| Treating | Selectivity to Gasoline | | | Coke, wt. % of Feed | | | SCF $H_2$/Barrel Converted | | |
|---|---|---|---|---|---|---|---|---|---|
| Agent[1] | A | B | C | A | B | C | A | B | C |
| 0.1 | 1.04 | 1.00 | 1.02 | 0.95 | 0.92 | 1.00 | 0.69 | 0.85 | 0.91 |
| 0.2 | 1.06 | 1.00 | 1.04 | 0.92 | 0.87 | 0.98 | 0.62 | 0.75 | 0.86 |
| 0.3 | 1.07 | 1.00 | 1.05 | 0.88 | 0.83 | 0.97 | 0.60 | 0.68 | 0.82 |
| 0.4 | 1.08 | 1.00 | 1.04 | 0.87 | 0.81 | 0.97 | 0.58 | 0.63 | 0.79 |
| 0.5 | 1.09 | 1.00 | 1.04 | 0.85 | 0.80 | 0.96 | 0.56 | 0.60 | 0.78 |
| 1.0 | 1.12 | 1.02 | 1.01 | 0.85 | 0.80 | 0.92 | 0.56 | 0.56 | 0.74 |

[1]The figures refer to weight percent of antimony for run A where the treating agent is antimony 0,0-dipropylphosphorodithioate having an antimony content of 10.9 wt. %, and run B where the treating agent is triphenylantimony, and to weight percent phosphorus for run C where the treating agent is tributylphosphine.

From the results of this table it can be seen that the antimony O,O-dipropylphosphorodithioate compound treating agent provides the best overall results of the tested additives. The high selectivity for the formation of gasoline and the lowest amount of hydrogen produced is achieved by the additive of this invention whereas the coke formation is intermediate between the coke formations of the other two additives.

In addition to the mechanical problems that arise from premature decomposition of the additive, antimony O,O-dipropylphosphorodithioate, it is believed that the effectiveness of the additive is also diminished in the process. This is illustrated by the foregoing Example II and the results set forth in Table II which show that the additive employed therein, antimony O,O-dipropylphosphorodithioate compound, is more effective than the combination of equivalent quantities of phosphorus and antimony added separately, as tributylphosphine and triphenylantimony, respectively. This is not to imply that this additive decomposes to these compounds, but does imply that the antimony and phosphorus will, to some extent, become separated from each other and are not combined chemically in their most effective form after thermal decomposition.

To obviate this problem, the present invention contemplates the use of a slipstream of feedstock maintained at a temperature lower than that of the primary feedstock to the catalytic cracker to convey the passivating agent into the cracking unit. The slipstream and the passivating agent can be introduced directly into the cracking unit or can be introduced into the primary feedstock at a point just upstream of the cracking unit as desired. Suitable examples for use as such slipstreams are recycle streams from the column that fractionates the products from the catalytic cracker, e.g., decant oil and slurry recycle oil. Generally at least one of these streams will be maintained at a temperature below 260° C., because the maximum permissible temperature is determined by the rate at which the recycled fluid becomes coked. Commonly this temperature is about 210° C. Another slipstream which may be employed to convey the passivating agent into the cracking unit can be obtained by taking off a slipstream from the primary feedstock stream upstream of the preheater.

It should be understood that combinations of two or more of these slipstreams can also be employed to convey the passivating agent into the cracking unit.

In addition to the antimony O,O-dipropylphosphorodithioate additive discussed above, the invention is applicable to any additives that are thermally labile. This can include other antimony salts of dihydrocarbylphosphorodithioic acids, antimony salts of carbamic acids, antimony salts of carboxylic acids, antimony salts of organic carbonic acids, and the like and mixtures of two or more thereof. Safe temperatures for such additional additives can readily be determined by experimentation using conventional thermal gravimetric analysis, differential thermal analysis, the heat exchanger technique described above, or any other useful procedure.

Referring now to the drawing, there is schematically illustrated therein a catalytic cracking system illustrative of the present invention. The system comprises a first catalytic cracking regeneration loop 10 and a second catalytic cracking regeneration loop 12. The first cracking regeneration loop 10 includes a catalytic cracking reactor 14 and a catalyst regenerator 16. Gaseous mixed cracked hydrocarbon products are conducted from the reactor 14 via conduit 18 to a first fractionation zone in the form of a fractionation column 20. The fractionation column 20 is connected at its lower end to a suitable decanting apparatus 22.

Similarly, the second cracking regeneration loop 12 includes a catalytic cracking reactor 24 and a catalyst regenerator 26. The cracking reactor 24 is connected via conduit 28 to a second fractionation zone in the form of a fractionation column 30. The fractionation column 30 is connected to a suitable decanting apparatus 32.

The system is further provided with a source of hydrocarbon feedstock 34 which provides the primary feedstock stream to the system, a suitable hydrocarbon feedstock being topped crude. The system is also provided with a source of gas oil 36 which provides at least a portion of the hydrocarbon feedstock directed to the second catalytic cracking reactor 24.

A source of metals passivation agent 38 is also provided for the system. The source 38 can be a suitable storage and distribution container in which passivating agent, such as the antimony salt of a dihydrocarbylphosphorodithioic acid, such as antimony, O,O-dipropylphosphorodithioate compound, in solution with a neutral hydrocarbon oil, is stored and dispensed during the operation of the system.

During the operation of the system, topped crude feedstock is provided from the source 34 via a preheating zone in the form of a preheater 40 to the cracking zone of the reactor 14 in which the primary feedstock is contacted in the cracking zone with a suitable cracking catalyst under suitable cracking temperature conditions. Mixed gaseous cracked hydrocarbon products resulting from the catalytic cracking are separated from the catalyst and are conducted from the cracking reactor 14 via the conduit 18 to the fractionation column 20 where the various hydrocarbon fractions are separated. Gasoline and light hydrocarbons are taken from the fractionation column 20 at 42 while light cycle oil is taken off the fractionation column 20 at 44 and heavier cycle oils are taken off at 46 and 48. Bottom ends or bottoms products and catalyst particles suspended therein leave the fractionation column 20 at 50 and all or substantially all of these bottom ends are conducted to the decanting apparatus 22. The bottom ends and catalyst particles are decanted in the apparatus 22 by conventional means with decant oil being taken therefrom at 52 and the heavier slurry oil and catalyst particles being taken therefrom at 54.

Spent catalyst is taken from the cracking reactor 14 at 56 and is conveyed, together with free oxygen-containing gas such as air, to the catalyst regenerator 16 at 58. The spent catalyst and air are maintained at catalyst regeneration temperature conditions within the catalyst regenerator 16 to remove coke from the catalyst. The catalyst and resulting flue gases are separated within the regenerator and the flue gases are vented therefrom at 60 while the regenerated catalyst is conveyed therefrom at 62 where it is mixed with the incoming primary feedstock stream and recycled to the cracking reactor 14.

The metals passivation agent is conducted from the storage reservoir 38 to the cracking reactor 14 via conduit 64. The passivation agent is preferably mixed with the primary feedstock stream at a point downstream of the preheater 40 and as close to the point of entry into the cracking reactor 14 as possible in order to minimize the heating of the passivation agent until it is in contact with the catalyst within the cracking reactor 14.

The passivation agent is conveyed in a passivation stream through the conduit 64 by one or more of a number of available slipstreams which are below a temperature of 260° C. One slipstream can be taken from the primary hydrocarbon feedstock stream upstream of the preheater 14 via a suitable control valve 66. Another slipstream can be taken from the bottom ends emanating from the fractionation column 20 upstream of the decanting apparatus 22 via a control valve 68. Yet another slipstream can be taken from the slurry oil emanating from the decanting apparatus 22 at 54 via a control valve 70. Still another slipstream can be taken from the decant oil emanating from the decanting apparatus 22 at 52 via a control valve 72.

A portion or all of the slurry oil from the decanting apparatus 22 can be directed, along with gas oil preheated at a preheater 72, steam and regenerated catalyst from the second catalyst regenerator 26 via conduit 74, to the cracking zone of the second catalytic cracking reactor 24 via conduit 76. The slurry oil and gas oil are contacted with suitable catalyst under hydrocarbon cracking temperature conditions within the cracking zone of the second cracking reactor 24 and mixed gaseous cracked hydrocarbon products resulting therefrom are separated from the catalyst and conducted via conduit 28 to the second fractionation column 30 where the hydrocarbon fractions are separated. Gasoline and light hydrocarbon fractions are taken off at 78 while light cycle oil is taken off at 80 from the fractionation column 30. Heavier cycle oils are taken off at 82 and 84 of the fractionation column 30 while bottom ends or bottoms product and catalyst fines suspended therein are taken off at 86.

The bottom ends from the fractionation column 30 are conveyed to the decanting apparatus 32 where the bottom ends are decanted by conventional means and decant oil is taken therefrom at 88 and the slurry oil is taken therefrom at 90.

Spent catalyst is conducted from the cracking reactor 24 at 92 and is conducted, along with a free oxygen-containing gas such as air, to the second catalyst regenerator 26 via conduit 94. The spent catalyst and air are subjected to suitable temperature conditions within the catalyst regenerator 26 to regenerate and decoke the spent catalyst. The spent catalyst is separated from the flue gases within the catalyst regenerator 26 and the flue gases are vented therefrom at 96. The separated regenerated catalyst is conducted from the catalyst regenerator via conduit 74 where it is recycled to the cracking reactor 24 with the gas oil feedstock.

The second cracking regeneration loop 12 provides three additional recycle streams from which one or more suitable slipstreams can be obtained to convey the metals passivation agent as a passivation stream to its point of introduction at the first cracking reactor 14. A first slipstream can be obtained from the bottom ends emanating from the second fractionation column 30 at 86 via a suitable control valve 98. A second slipstream can be taken from the slurry oil emanating from the decanting apparatus 32 at 90 via control valve 100, while a third slipstream can be taken from the decant oil emanating from the decanting apparatus 32 at 88 via control valve 102.

It will thus be seen that a number of recycle streams are available in the system described above to provide a feedstock stream at a temperature below 260° C. to convey passivation agent from the source 38 to a point of mixture with the preheated primary feedstock stream just upstream of the first cracking reactor 14. While it is presently preferred to blend the passivation stream and the heated primary feedstock stream prior to entry into the catalyst within the cracking reactor 14 to achieve optimum distribution of metals passivation agent in the catalyst, it will be understood that the present invention also encompasses the utilization of separate points of entry of the primary feedstock stream and the passivation stream into the catalyst within the cracking reactor should this become advantageous due to particular reactor configuration or the like. It should also be emphasized again that the various slipstreams described above in conjunction with the disclosed system can be utilized individually or any two or more of the streams can be combined to achieve optimum temperature, flow rate and feedstock composition. While the invention has been illustrated in terms of a presently preferred embodiment, it will be understood that other configurations can be employed such as a single catalytic cracking regeneration loop. Other reasonable variations and modifications are possible within the scope of the foregoing disclosure, the drawing and the appended claims to the invention.

That which is claimed is:

1. In a catalytic cracking process of the type in which a preheated hydrocarbon feedstock stream is contacted with a cracking catalyst in a cracking zone under elevated cracking temperature conditions to produce a cracked product, the improvement comprising:

introducing a metals passivating agent into a separate fluid stream to form a passivation stream at a temperature below the thermal decomposition temperature of said metal passivating agent; and introducing said passivation stream into said cracking zone so as to maintain said metals passivating agent substantially free of thermal decomposition until contacting said cracking catalyst so as to passivate metals contaminating said cracking catalyst.

2. A process in accordance with claim 1 wherein said passivation stream and said preheated hydrocarbon feedstock stream are introduced together into said cracking zone.

3. A process in accordance with claim 1 wherein said passivation stream is introduced into said preheated hydrocarbon feedstock stream upstream from said cracking zone so that said passivation stream and said preheated feedstock stream are introduced together into said cracking zone.

4. A process in accordance with claim 1 wherein at least a portion of said fluid stream is provided by a portion of said hydrocarbon feedstock stream taken from said hydrocarbon feedstock stream prior to preheating of said hydrocarbon feedstock stream.

5. A process in accordance with claim 1 wherein said cracked product is separated into hydrocarbon fractions including a hydrocarbon bottoms product, and wherein at least a portion of said fluid stream is provided by at least a portion of said hydrocarbon bottoms product.

6. A process in accordance with claim 1 wherein said cracked product is separated into hydrocarbon fractions including a hydrocarbon bottoms product having catalyst fines therein; said bottoms product is decanted so as to separate a decant oil from a heavier slurry oil comprising said bottoms product and catalyst fines; and at least a portion of said fluid stream is provided by at least a portion of said decant oil.

7. A process in accordance with claim 6 wherein at least a portion of said fluid stream is provided by at least a portion of said slurry oil.

8. A process in accordance with claim 1 wherein:

said cracked product is separated into hydrocarbon fractions including a first slurry oil comprising a first hydrocarbon bottoms product having first catalyst fines therein;

at least a portion of said first slurry oil is introduced into a second cracking zone;

a second hydrocarbon feedstock stream is introduced into said second cracking zone;

said first slurry oil and said second hydrocarbon feedstock stream are contacted in said second cracking zone with a second cracking catalyst under cracking temperature conditions so as to produce a second cracked product; and said second cracked product is separated into hydrocarbon fractions including a second slurry oil comprising a second hydrocarbon bottoms product having second catalyst fines therein.

9. A process in accordance with claim 8 wherein at least a portion of said fluid stream is provided by at least a portion of said second slurry oil.

10. A process in accordance with claim 8 wherein said second slurry oil is decanted to separate a lighter second decant oil from said heavier second bottoms product having second catalyst fines therein; and at least a portion of said fluid stream is provided by at least a portion of said second decant oil.

11. A cracking process comprising the steps of:

introducing at least a portion of a first hydrocarbon feedstock stream into a preheating zone so as to preheat said at least a portion of said first feedstock stream to an elevated temperature;

introducing said preheated at least a portion of said first feedstock stream into a first cracking zone;

contacting said at least a portion of said first feedstock stream in said first cracking zone with a first cracking catalyst under elevated cracking temperature conditions so as to produce a first cracked product;

withdrawing said first cracked product from said first cracking zone;

separating said first cracked product from at least a portion of said first cracking catalyst;

introducing said at least a portion of said thus separated first cracking catalyst into a first regeneration zone;

contacting said first cracking catalyst in said first regeneration zone with free oxygen-containing gas so as to burn off at least a portion of any coke deposited on said first cracking catalyst and provide a regenerated first catalyst;

reintroducing said regenerated first catalyst into said first cracking zone;

introducing a metals passivating agent into a fluid stream so as to form a passivation stream at a temperature below the thermal decomposition temperature of said metals passivating agent; and introducing said passivation stream and said preheated first feedstock stream into said first cracking zone so as to maintain said metals passivating agent substantially free of decomposition until contacting said first cracking catalyst with said metals passivating agent.

12. A process in accordance with claim 11 wherein at least a portion of said fluid stream is provided by a portion of said first feedstock stream taken off upstream of said preheating zone.

13. A process in accordance with claim 11 characterized further to include:

introducing said separated first cracked product into a first fractionation zone so as to separate said first cracked product into hydrocarbon fractions including a first slurry oil comprising a first hydrocarbon bottoms product having first catalyst fines therein; and wherein at least a portion of said fluid stream is provided by at least a portion of said first slurry oil from said first fractionating zone.

14. A process in accordance with claim 11 characterized further to include:

introducing said separated first cracked product into a first fractionation zone so as to separate said first cracked product into hydrocarbon fractions including a first hydrocarbon bottoms product having first catalyst fines therein;

decanting said first hydrocarbon bottoms product so as to separate a first decant oil from a heavier first slurry oil comprising a first bottoms product having first catalyst fines therein; and wherein at least a portion of said fluid stream is provided by at least a portion of said first decant oil.

15. A process in accordance with claim 14 wherein at least a portion of said fluid stream is provided by at least a portion of said first slurry oil.

16. A process in accordance with claim 11 characterized further to include:

introducing said separated first cracked product into a first fractionation zone so as to separate said first cracked product into hydrocarbon fractions including a first slurry oil comprising a first hydrocarbon bottoms product having first catalyst fines therein;

introducing at least a portion of said first slurry oil into a second cracking zone;

introducing a second hydrocarbon feedstock stream into said second cracking zone;

contacting said first slurry oil and said second feedstock stream in said second cracking zone with a second cracking catalyst under cracking temperature conditions so as to produce a second cracked product;

withdrawing said second cracked product from said second cracking zone;

separating said second cracked product from at least a portion of said second cracking catalyst;

introducing said at least a portion of said thus separated second catalyst into a second regeneration zone;

contacting said second catalyst in said second regeneration zone with free oxygen-containing gas so as to burn off at least a portion of any coke deposited on said second cracking catalyst and provide regenerated second catalyst;

reintroducing said regenerated second catalyst into said second cracking zone; and introducing said separated second cracked product into a second fractionation zone so as to separate said second cracked product into hydrocarbon fractions including a second slurry oil comprising a second hydrocarbon bottoms product having second catalyst fines therein.

17. A process in accordance with claim 16 wherein at least a portion of said fluid stream is provided by at least a portion of said second slurry oil from said second fractionating zone.

18. A process in accordance with claim 16 characterized further to include:

decanting said second slurry oil so as to separate a lighter second decant oil from said heavier second slurry oil comprising a heavier second bottoms product having second catalyst fines therein; and wherein at least a portion of said fluid stream is provided by at least a portion of said second decant oil.

19. A process in accordance with claim 18 wherein at least a portion of said fluid stream is provided by at least a portion of said second slurry oil.

20. A process in accordance with claim 16 characterized further to include:

decanting said first slurry oil so as to separate a lighter first decant oil from said heavier first slurry oil comprising a heavier first bottoms product having first catalyst fines therein; and wherein at least a portion of said fluid is provided by fluids selected from the group consisting of a portion of said first feedstock stream taken off upstream of said preheating zone; at least a portion of said first decant oil; at least a portion of said first slurry oil; at least a portion of said second decant oil; at least a portion of said second slurry oil; and mixtures of any two or more thereof.

21. A process in accordance with claim 1 or claim 11 wherein said metals passivating agent is selected from the group consisting of antimony salts of dihydrocarbylphosphorodithioic acids; antimony salts of carbamic acids; antimony salts of carboxylic acids; antimony salts of organic carbonic acids; and mixtures of any two or more thereof.

22. A process in accordance with claim 1 or claim 11 wherein said metals passivating agent is an antimony O,O-dihydrocarbylphosphorodithioate compound.

23. A process in accordance with claim 20 wherein said metals passivating agent is selected from the group consisting of antimony salts of dihydrocarbylphosphorodithioic acids; antimony salts of carbamic acids; antimony salts of carboxylic acids; antimony salts of carbamic acids; and mixtures of at least two thereof.

24. A process in accordance with claim 20 wherein said metals passivating agent is an antimony O,O-dihydrocarbylphosphorodithioate compound.

25. A process in accordance with claim 11 wherein said passivation stream is introduced into said preheated first feedstock stream upstream from said first cracking zone so that said passivation stream and said first feedstock stream are introduced together into said first cracking zone so as to maintain said metals passivating agent substantially free of decomposition until contacting said first cracking catalyst.

26. A process in accordance with claim 1 or claim 11 wherein fluid stream is at a temperature below 260° C. at the time of introduction of said metals passivating agent into said fluid stream.

* * * * *